US007549716B2

(12) United States Patent
Kida et al.

(10) Patent No.: US 7,549,716 B2
(45) Date of Patent: Jun. 23, 2009

(54) METHOD OF EJECTING MICRODROPLETS OF INK

(75) Inventors: Hitoshi Kida, Hitachinaka (JP); Takahiro Yamada, Hitachinaka (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 225 days.

(21) Appl. No.: 11/427,502

(22) Filed: Jun. 29, 2006

(65) Prior Publication Data

US 2007/0002091 A1 Jan. 4, 2007

(30) Foreign Application Priority Data

Jul. 1, 2005 (JP) ..... P2005-193729

(51) Int. Cl.
*B41J 29/38* (2006.01)

(52) U.S. Cl. ..... 347/10; 347/9; 347/11

(58) Field of Classification Search ..... 347/10–11, 347/13, 17, 19, 89, 9
See application file for complete search history.

(56) References Cited

U.S. PATENT DOCUMENTS 4,593,291 A 6/1986 Howkins
6,183,063 B1 * 2/2001 Bolash et al. ..... 347/42
6,273,537 B1 * 8/2001 Hiwada ..... 347/10
6,312,077 B1 * 11/2001 Araki ..... 347/11
7,125,110 B2 * 10/2006 Merz et al. ..... 347/89

FOREIGN PATENT DOCUMENTS

| | | |
|---|---|---|
| JP | 4-36071 | 6/1992 |
| JP | 2000-141642 | 5/2000 |
| JP | 3159188 | 2/2001 |
| JP | 3491187 | 11/2003 |

* cited by examiner

*Primary Examiner*—Lam S Nguyen
(74) *Attorney, Agent, or Firm*—Whitham Curtis Christofferson & Cook, PC

(57) ABSTRACT

The method of ejecting microdroplets of ink includes a first step for generating one ink column on the outside of the nozzle and for separating a tip end of the one ink column from a remaining part of the one ink column to form a microdroplet of ink on the outside of one nozzle, and a second step for controlling an ink volume velocity in the ink pressure chamber that is connected to the nozzle to generate another ink column and to push the another ink column out of the nozzle, thereby causing the another ink column to overtake and merge with the remaining part of the one ink column and to return into the nozzle while pulling the remaining part of the one ink column back into the nozzle.

12 Claims, 12 Drawing Sheets

METHOD OF EJECTING MICRODROPLETS OF INK

BACKGROUND OF THE INVENTION

The present invention relates to a method of ejecting microdroplets of ink, and a particularly to such a method employed in an inkjet head driving method for applying pressure to ink in ink pressure chambers to eject microdroplets of ink from nozzles in communication with the ink pressure chambers.

A drop-on-demand inkjet technology well known in the art ejects ink droplets by applying a drive voltage waveform to piezoelectric elements. Inkjet printers employing this method render diverse colors on a recording medium by forming clusters of dots in a limited number of ink colors on the recording medium. Consequently, images formed by these types of inkjet printers tend to be particularly grainy in the highlights. Studies have been conducted on reducing the size of the ejected ink droplets in order to reduce the size of the dots formed on the recording medium and obtain higher image quality with no graininess.

Further, there have been studies conducted in recent years on using inkjet technology to form integrated circuits through patterning with conductive ink and to form a variety of thin films. Producing smaller ink droplets is also expected to be useful for forming high-density interconnects and uniform ultrathin films.

Certainly the size of ejected ink droplets can be easily reduced by reducing the diameter of the nozzles. However, high accuracy of the nozzles resulting from reducing the nozzle diameter leads to higher production costs. Further, the smaller nozzle openings become clogged more easily with foreign matter and ink deposits, leading to ejection problems.

However, one method enables the ejection of ink droplets that are smaller than the nozzle diameter by controlling oscillations of the ink surface in the nozzle opening (hereinafter referred to as the "meniscus").

Japanese Patent Application Publication No. HEI-4-36071 discloses a method of ejecting small ink droplets by rapidly drawing in and holding the meniscus, causing the ink to rebound in the center of the meniscus and form a small ink droplet that is ejected therefrom. Japanese Patent No. 3,491,187 discloses a method of ejecting small ink droplets by drawing the meniscus far into the nozzle and subsequently contracting the chamber to generate and eject a narrow column of ink from only the center of the meniscus. Japanese Patent Application Publication No. 2000-141642 and Japanese Patent No. 3,159,188 disclose a method of reducing the size of ejected ink droplets by first drawing in the meniscus and then contracting the pressure chamber to form an ink column on the outside of the nozzle, and subsequently drawing in the meniscus again to reduce the volume of ejected ink.

SUMMARY OF THE INVENTION

In order to eject ink droplets at a mean velocity of at least 5 m/s in the methods described above, the velocity required for ensuring a stable trajectory over a distance of about 1 mm, the volume of the ink droplets must be at least about 1 picoliter (pl) for a nozzle diameter of about 30 μm. However, industrial applications for inkjet technology, such as the formation of high-density interconnects using conductive ink, require even smaller ink droplets.

In view of the foregoing, it is an object of the present invention to provide a method of ejecting microdroplets of ink on a sub-picoliter order using inkjet technology.

This and other objects of the invention will be attained by a method of ejecting microdroplets of ink by driving an inkjet head. The inkjet head includes a plate and a pressure generating member. The plate is formed with a plurality of nozzles for ejecting ink droplets and a plurality of pressure chambers in fluid communication with the plurality of nozzles, respectively. The plate has an outside surface, on which the nozzle is opened. The pressure generating member applies pressure to ink in each ink pressure chamber in response to electric signals applied to the pressure generating member. The method includes a first step for generating one ink column on the outside of the nozzle and for separating a tip end of the one ink column from a remaining part of the one ink column to form a microdroplet of ink on the outside of one nozzle, and a second step for controlling an ink volume velocity in the ink pressure chamber that is connected to the nozzle to generate another ink column and to push the another ink column out of the nozzle, thereby causing the another ink column to overtake and merge with the remaining part of the one ink column and to return into the nozzle while pulling the remaining part of the one ink column back into the nozzle.

In another aspect of the invention, there is provided an ink jet head including a plate, a pressure generating member, and a controller. The plate is formed with a plurality of nozzles for ejecting ink droplets and a plurality of pressure chambers in fluid communication with the plurality of nozzles, respectively. The plate has an outside surface, on which the nozzles are opened. The pressure generating member for applying pressure to ink in each ink pressure chamber in response to electric signals applied to the pressure generating member.

The controller controls ejecting of microdoplets of ink from the nozzles, the ejecting microdroplets of ink including: a first step for generating one ink column on the outside of the nozzle and for separating a tip end of the one ink column from a remaining part of the one ink column to form a microdroplet of ink on the outside of one nozzle; and a second step for controlling an ink volume velocity in the ink pressure chamber that is connected to the nozzle to generate another ink column and to push the another ink column out of the nozzle, thereby causing the another ink column to overtake and merge with the remaining part of the one ink column and to return into the nozzle while pulling the remaining part of the one ink column back into the nozzle.

In another aspect of the invention, there is provided a method of ejecting microdroplets of ink by driving an inkjet head. The ink head includes a plate and a pressure generating member. The plate is formed with a plurality of nozzles for ejecting ink droplets and a plurality of pressure chambers in fluid communication with the plurality of nozzles, respectively. The pressure generating member is adapted for applying pressure to ink in each ink pressure chamber in response to driving voltage applied to the pressure generating member. The plate has an outside surface, on which the nozzles are opened.

The method includes decreasing the driving voltage to rapidly draw in a meniscus of the ink into the nozzle; maintaining the driving voltage at a constant value for a period of time, thereby allowing the meniscus to rebound and generate one ink column; decreasing the driving voltage to reduce volume of the one ink column; maintaining the driving voltage at another constant value for another period of time to separate a tip end of the one ink column from a remaining part of the one ink column to form a microdroplet of ink; and increasing the driving voltage to generate another ink column to push the another ink column out of the nozzle to cause the another ink column to overtake and merge with the remaining part of the one ink column and pull the remaining part of the one ink column into the nozzle.

In another aspect of the invention, there is provided a method of ejecting microdroplets of ink by driving an inkjet head. The ink jet head includes a plate and a pressure generating member. The plate is formed with a plurality of nozzles for ejecting ink droplets and a plurality of pressure chambers in fluid communication with the plurality of nozzles, respectively. The plate has an outside surface, on which the nozzles are opened. The pressure generating member applies pressure to ink in each ink pressure chamber in response to driving voltage applied to the pressure generating member.

The method includes: decreasing the driving voltage to draw in a meniscus of the ink into the nozzle; maintaining the driving voltage at a constant value for a period of time; increasing the driving voltage to push out the meniscus to generate one ink column; maintaining the driving voltage at another constant value for another period of time; decreasing the driving voltage to draw in the meniscus of the ink into the nozzle to reduce volume of the ink column and to separate a tip end of the one ink column from a remaining part of the one ink column to form a microdroplet of ink; maintaining the driving voltage at another constant value for another period of time; and increasing the driving voltage to generate another ink column to push the another ink column out of the nozzle to cause the another ink column to overtake and merge with the remaining part of the one ink column and pull the remaining part of the one ink column into the nozzle.

In another aspect of the invention, there is provided a method of ejecting microdroplets of ink by driving an inkjet head. The ink jet head includes a plate and a pressure generating member. The plate is formed with a plurality of nozzles for ejecting ink droplets and a plurality of pressure chambers in fluid communication with the plurality of nozzles, respectively. The plate has an outside surface, on which the nozzles are opened. The pressure generating member applies pressure to ink in each ink pressure chamber in response to driving voltage applied to the pressure generating member.

The method includes: decreasing the driving voltage to draw in a meniscus into the nozzle; maintaining the driving voltage to a constant value for a period of time; increasing the driving voltage to push out the meniscus to generate one ink column and to separate a tip end of the one ink column from a remaining part of the one ink column to form a microdroplet of ink; maintaining the driving voltage to another constant value for another period of time; and increasing the driving voltage to generate another ink column to push the another ink column out of the nozzle to cause the another ink column to overtake and merge with the remaining part of the one ink column and pull the remaining part of the one ink column into the nozzle.

DESCRIPTION OF THE PREFERRED EMBODIMENTS

A method of ejecting microdroplets of ink according to preferred embodiments of the present invention will be described while referring to the accompanying drawings.

Figure 1A:
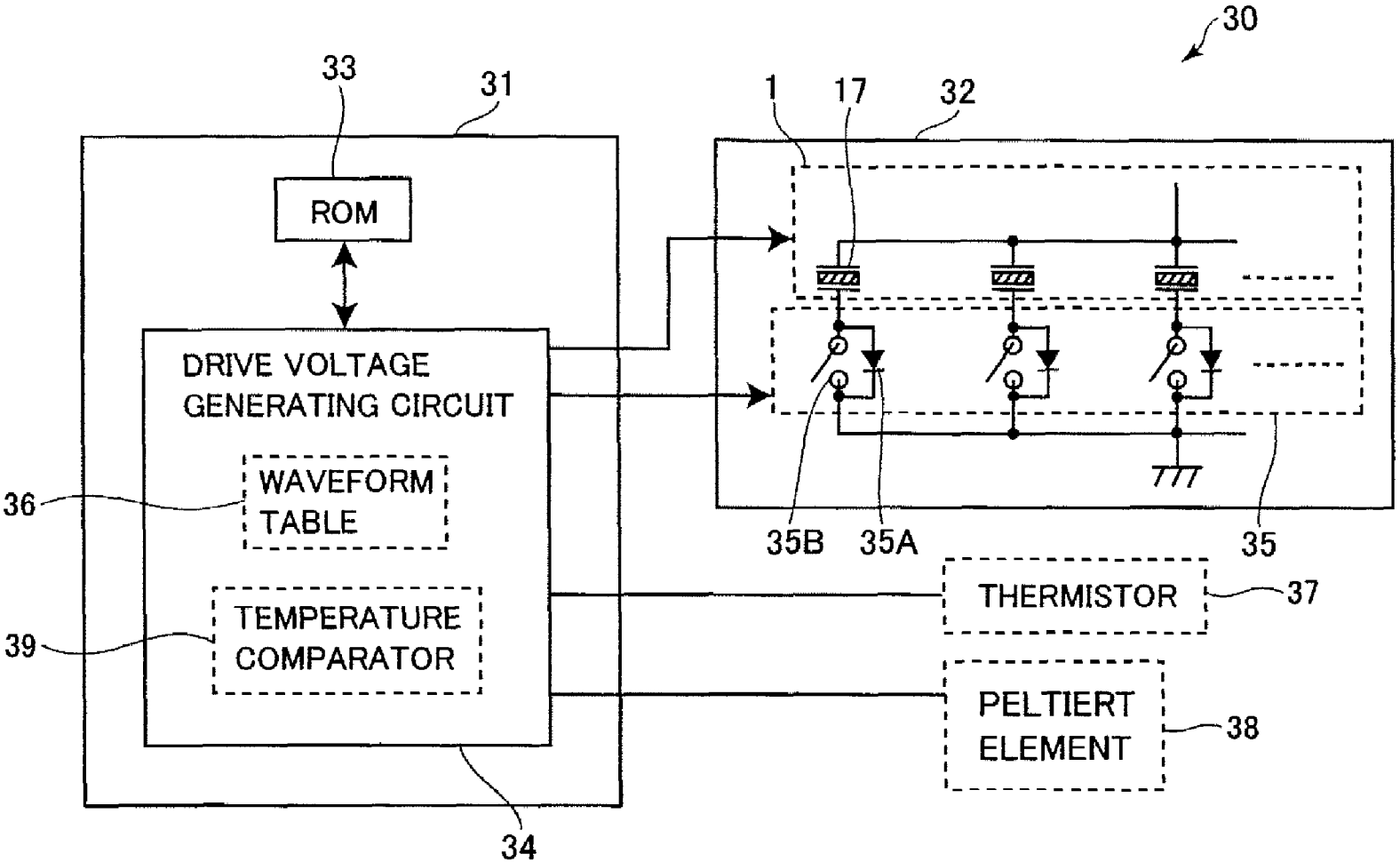
FIG. 1A is a block diagram of an inkjet recording device including an inkjet head applying a method of ejecting microdroplets of ink according to a preferred embodiment of the present invention.

FIG. 1A is a block diagram of an inkjet recording device 30 including an inkjet head 1 applying a method of ejecting microdroplets of ink according to a preferred embodiment of the present invention. The inkjet recording device 30 includes a printing controller 31 and a print head 32.

The printing controller 31 has a ROM 33 and a drive voltage generating circuit 34. The ROM stores programs for controlling the drive voltage generating circuit 34 and the print head 32. The print head 32 has the inkjet head 1 and a drive nozzle selection circuit 35.

Figure 1B:
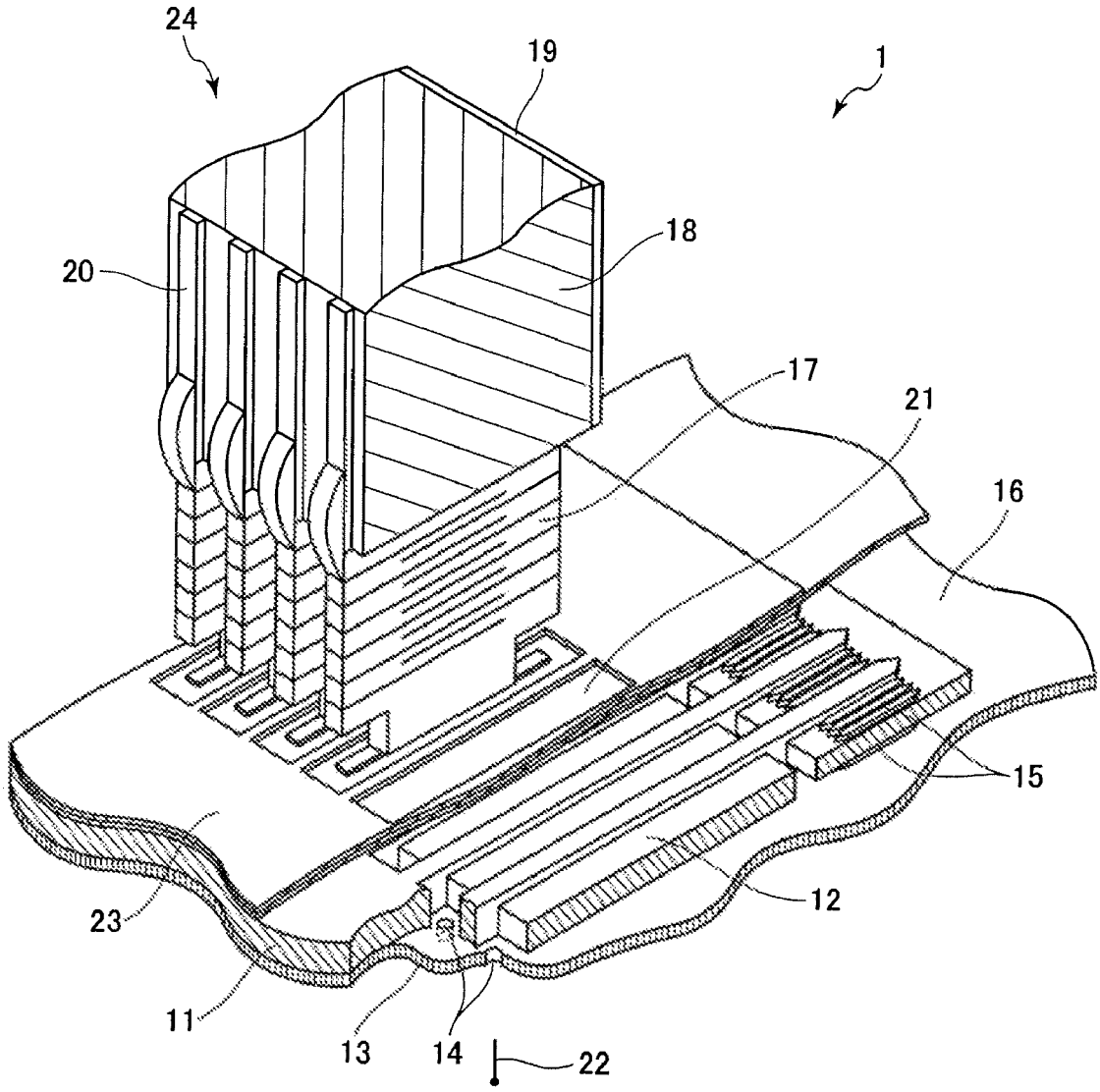
FIG. 1B is a partially cut out perspective view of an inkjet head applying a method of ejecting microdroplets of ink according to a preferred embodiment of the present invention.

FIG. 1B is a partially cut out perspective view of the inkjet head 1 applying a method of ejecting microdroplets of ink. The inkjet head 1 includes a nozzle plate 13, an ink channel forming section 11, an elastic film 21, and a support plate 23 that are all laminated and fixed together. The inkjet head 1 also includes a piezoelectric actuator 24.

A plurality of nozzles 14 for ejecting ink droplets is formed in the nozzle plate 13. The nozzles 14 are arranged in a row at intervals of 1/100 of an inch. The ink channel forming section 11 has ink pressure chambers 12, restrictors 15, and a common ink channel 16 formed therein. One end of the ink pressure chambers 12 is in communication with respective nozzles 14, while the other end is in fluid communication with respective restrictors 15. The restrictors 15 suppress a drop in pressure applied to the ink in the ink pressure chambers 12 by piezoelectric elements 17 described later. The cross-sectional area of the ink channel formed in the restrictors 15 is smaller than that of the ink channel formed in the ink pressure chambers 12. The restrictors 15 are also in fluid communication with the common ink channel 16. Cutout portions are formed in the support plate 23 in areas opposing the ink pressure chambers 12 via the elastic film 21 to expose the elastic film 21 from the support plate 23.

The piezoelectric actuator 24 includes the piezoelectric elements 17 formed of laminated conductive material and piezoelectric material, piezoelectric element support member 18, a positive electrode 19, and negative electrodes 20. Each piezoelectric element 17 is fixed to the piezoelectric element support member 18, with an end of the piezoelectric element 17 connected to the elastic film 21 exposed through the support plate 23. The piezoelectric element 17 generates pressure to the ink in the ink pressure chambers 12 through displacement according to the d33 direction of the piezoelectric element 17. If the voltage applied to the positive electrode 19 drops, causing electrical discharge, the piezoelectric element 17 contracts to reduce the pressure in the ink pressure chamber 12. If the voltage applied to the positive electrode 19 increases, generating electrical charge, the piezoelectric element 17 expands to increase the pressure of the ink pressure chamber 12.

The positive electrode 19 is a common electrode to all piezoelectric elements 17 disposed on one side surface of the support member 18 and connected to the drive voltage generating circuit 34 (FIG. 1A). The negative electrodes 20 are individual electrodes corresponding to each individual piezoelectric element 17 and are disposed on the opposite side surface of the support member 18 and are grounded through the drive nozzle selection circuit 35. As shown in FIG. 1A, since diodes 35A are arranged on the drive nozzle selection circuit 35 in parallel to drive nozzle selection switches 35B for flowing an electric current toward a ground, the piezoelectric elements 17 are charged regardless of the drive nozzle selection state. A drive voltage waveform stored in the drive voltage generating circuit 34 is applied to the positive electrode 19 of the piezoelectric element 17. A printing data is output to the drive nozzle selection circuit 35 from the drive voltage generating circuit 34.

The elastic film 21 forms one wall of the ink pressure chambers 12. Hence, when the elastic film 21 deforms due to expansion and contraction of the piezoelectric elements 17, the volume in the corresponding ink pressure chambers 12 changes. The support plate 23 and the ink channel forming section 11 are fixed to a housing (not shown) so that there is almost no relative movement among these components.

With this construction, ink supplied from an ink bottle (not shown) passes through the common ink channel 16, restrictors 15, and ink pressure chambers 12 and is supplied to the nozzles 14. The elastic film 21 oscillates in response to signals that the positive and negative electrodes 19 and 20 apply to the piezoelectric elements 17, causing the corresponding ink pressure chambers 12 to compress. When one of the ink pressure chambers 12 compresses, an ink droplet 22 is ejected from the corresponding nozzle 14.

Next, principles for ejecting ink droplets from the inkjet head will be described.

Through the drive nozzle selection circuit 35 connected to the negative electrodes 20 of each piezoelectric element 17, the negative electrodes 20 connected to nozzles ejecting ink droplets are grounded, while the piezoelectric elements 17 are charged and discharged by voltage applied to the positive electrode 19. The piezoelectric elements 17 that are not grounded are not discharged. A DC voltage is applied to the positive electrode 19, charging the piezoelectric element 17, before ejecting ink droplets from the nozzles 14, so that the piezoelectric element 17 expands in the laminated direction and pushes the elastic film 21 into the ink pressure chamber 12. When ejecting ink droplets from the nozzles 14 by the piezoelectric elements 17, the voltage applied to the positive electrode 19 is reduced, causing the grounded piezoelectric element 17 to discharge and contract in the laminated direction. Accordingly, the elastic film 21 is pulled away from the ink pressure chamber 12, reducing the pressure in the ink pressure chamber 12 and allowing ink from the common ink channel 16 to flow into the ink pressure chamber 12 through the restrictor 15. Next, the voltage applied to the positive electrode 19 is increased so that the grounded discharged piezoelectric element 17 is charged. The charged piezoelectric element 17 expands in the laminated direction and again pushes the elastic film 21 into the ink pressure chamber 12, adding pressure to the ink in the ink pressure chamber 12. The ink is pushed out through the nozzle 14 in communication with the ink pressure chamber 12 as the ink droplet 22.

The inkjet head 1 is designed so that the flow resistance in the nozzle 14 is greater than that in the restrictor 15 and the inertance (inertia component in the fluid) in the nozzle 14 is smaller than that in the restrictor 15. Accordingly, in the decompression process of the ink pressure chamber 12, the piezoelectric element 17 is contracted to reduce the volume acceleration (rate of change) of fluid in the ink pressure chamber 12. When the volume in the ink pressure chamber 12 is changed slowly, flow resistance is dominant. Therefore, ink is more likely to flow into the ink pressure chamber 12 from the restrictor 15 having a relatively low flow resistance than is air to be drawn in from outside the nozzle 14. In contrast, in the compression process of the ink pressure chamber 12, the piezoelectric element 17 is expanded to increase the volume acceleration (rate of change) of fluid in the ink pressure chamber 12. When the volume in the ink pressure chamber 12 is changed rapidly, inertance is dominant. Therefore, an ink droplet is more likely to be ejected from the nozzle 14 having low inertance than is ink to return from the restrictor 15 to the common ink channel 16. Further, the nozzle 14 is formed so that the diameter of the nozzle 14 is wider on the ink pressure chamber 12 side than on the outer side through which the ink droplet 22 is ejected. Accordingly, the surface tension in a meniscus is greater during the decompression process than the compression process, making it more difficult for air to be drawn in during the decompression process and easier for ink droplets to be ejected during the compression process.

If the drive voltage applied to the positive electrode 19 of the piezoelectric element 17 is made to rise and fall in a shorter time or to fluctuate greatly at a time, the volume velocity of ink in the ink pressure chamber 12 increases, thereby increasing the ejected velocity of the ink droplet. When the drive voltage applied to the positive electrode 19 is made to rise and fall over a longer time or to fluctuate less at a time, the volume velocity of the ink decreases, thereby decreasing the ejected velocity of the ink droplet. Hence, the volume velocity of ink in the ink pressure chamber 12 can be controlled through the drive voltage waveform applied to the positive electrode 19 of the piezoelectric element 17.

Figure 2:
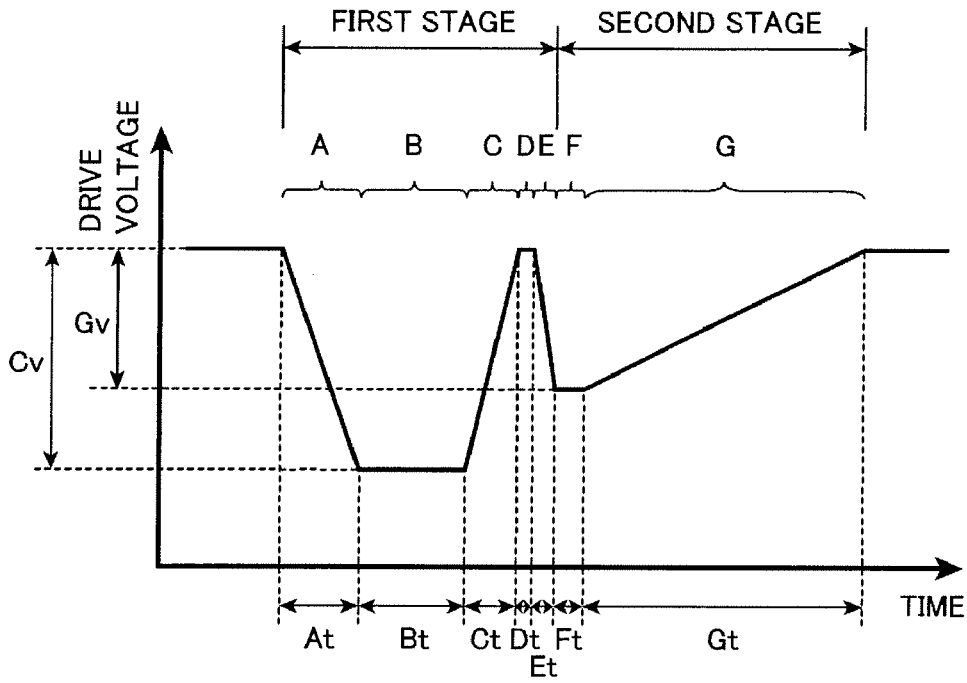
FIG. 2 is a graph showing a drive voltage waveform applied to a positive electrode of a piezoelectric element in the conventional method of ejecting microdroplets of ink.

FIG. 2 is a graph showing a drive voltage waveform studied by the inventors of the present invention to be applied to the positive electrode 19 of the piezoelectric element 17 for ejecting a small ink droplet. Steps A through E account for a first stage and steps F and G account for a second stage. In the first stage, the meniscus is drawn into the nozzle 14 in step A, the voltage is maintained for a fixed period of time in step B, and the meniscus is pushed outward in step C to generate an ink column. Once again the voltage is maintained for a fixed period of time in step D, and the meniscus is drawn into the nozzle in step E to reduce the volume of the ink column being ejected, forming a microcolumn of ink, and to eject a small ink droplet. In the second stage, the voltage is maintained for a fixed period in step F and is raised from a voltage lower than that in step E to the original voltage in step G.

Figure 3:
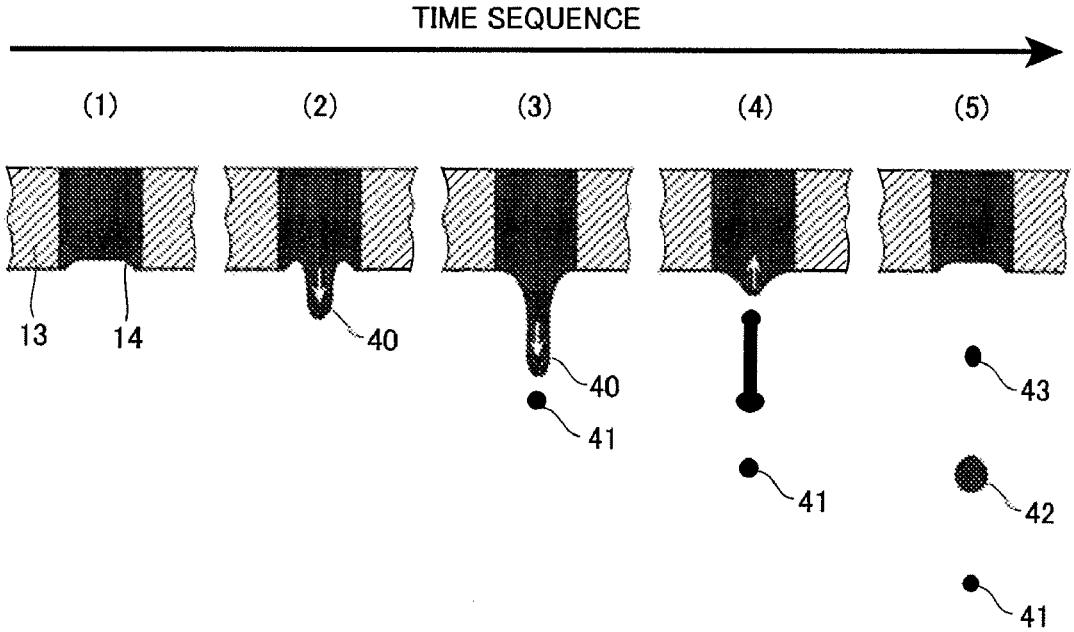
FIG. 3 is an explanatory diagram showing the result of ink droplet ejection when a drive voltage waveform shown in FIG. 2 is applied to the positive electrode of the piezoelectric element in a conventional method of ejecting ink droplets.

FIG. 3 shows the result of the ink droplet ejection when applying the drive voltage waveform shown in FIG. 2 to the positive electrode 19 of the piezoelectric element 17. Timing (2) of FIG. 3 shows the microcolumn 40 of ink generated in the first stage in FIG. 2. As shown in timing (3) of FIG. 3, after some time elapses, the tip end of the column 40 begins to separate into a microdroplet 41 of ink, and the microdroplet 41 begins to move away from the column 40. However, as shown in timings (4) and (5) of FIG. 3, the remaining ink column on the nozzle side of the microdroplet also begins to move away from the nozzle as a small ink droplet or as a small droplet 42 and a microdroplet 43 of ink. The plurality of ejected ink droplets impact the recording medium at substantially the same position to form a small dot.

Step G in FIG. 2 is configured to prevent a large amount of ink from being pushed out of the nozzle, by increasing the time Gt or decreasing the voltage Gv. Step G is executed at a timing for producing an oscillation of opposite phase to residual oscillations produced in the first stage in order to cancel these residual oscillations. This process restrains oscillation in the meniscus to prevent the generation of a large ink column in the second stage of the conventional method for merging with the previously generated ink column or ink droplet and returning the ink column or ink droplet into the nozzle.

First Embodiment

Figure 4:
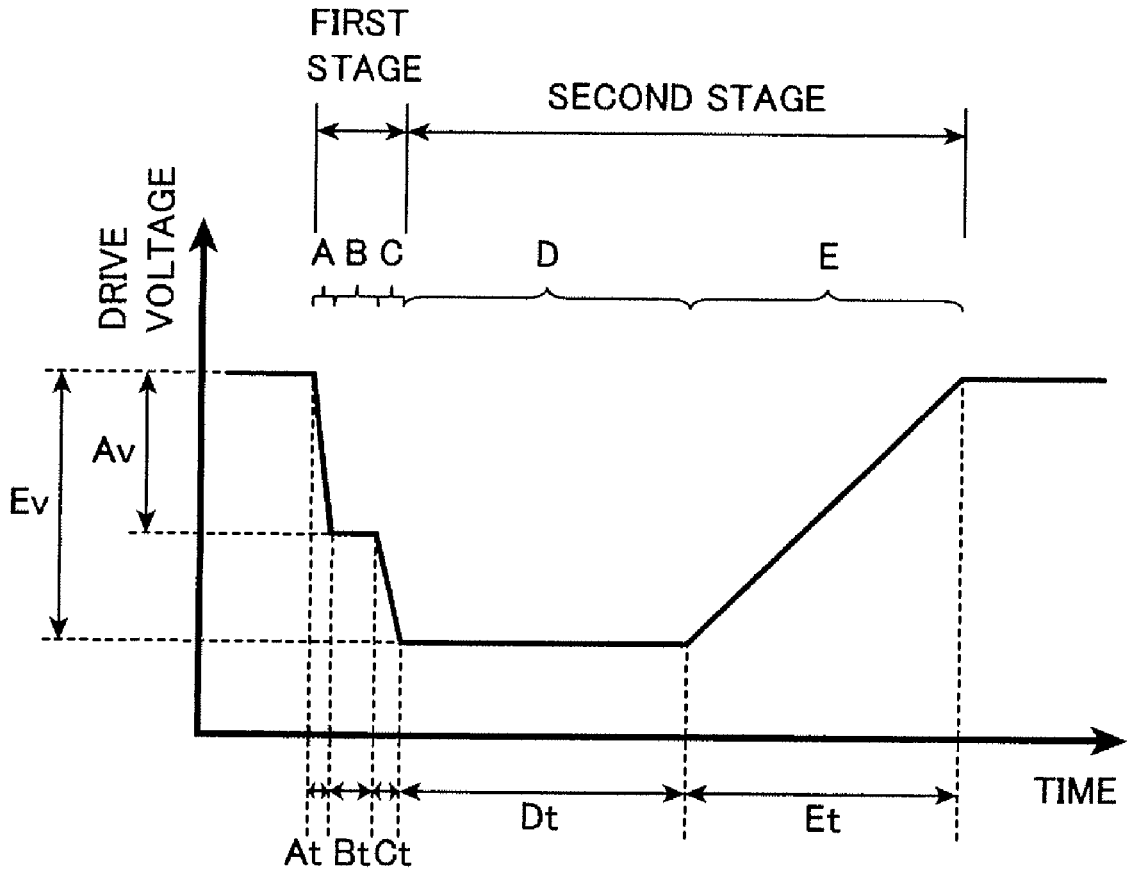
FIG. 4 is a graph showing a drive voltage waveform applied to a positive electrode of a piezoelectric element in the method of ejecting microdroplets of ink according to a first embodiment.

Next, a method of ejecting microdroplets of ink according to first embodiment of the present invention will be described. FIG. 4 shows a graph of a drive voltage waveform applied to the positive electrode 19 of the piezoelectric element 17 according to a first embodiment of the present invention. The first embodiment includes a first stage made up of either step A and B or steps A through C, and a second stage made up of steps D and E. The first stage is for forming a microdroplet of ink on the outside of the nozzle 14. The second stage is for controlling the ink volume velocity in the ink pressure chambers 12 to generate an ink column. In the first stage, the meniscus is rapidly drawn into the nozzle 14 in step A, and a microcolumn of ink is generated in step B by no longer drawing in the meniscus, allowing the meniscus to rebound. In step C the voltage is reduced far enough to obtain a potential difference required for step E and the meniscus is again drawn into the nozzle 14 to reduce volume of the microcolumn of ink (timing (2') of FIG. 5A and timing (3') of FIG. 6A). By setting the time Bt of step B to about 0.5-4 μs in order to generate a thinner microcolumn of ink through step C of the first stage, it is possible to reduce the amount of ink in the ink column to be ejected. In the second stage, the voltage is held for a fixed length of time in step D, and the ink column is pushed out of and returned into the nozzle in step E.

Figure 5A:
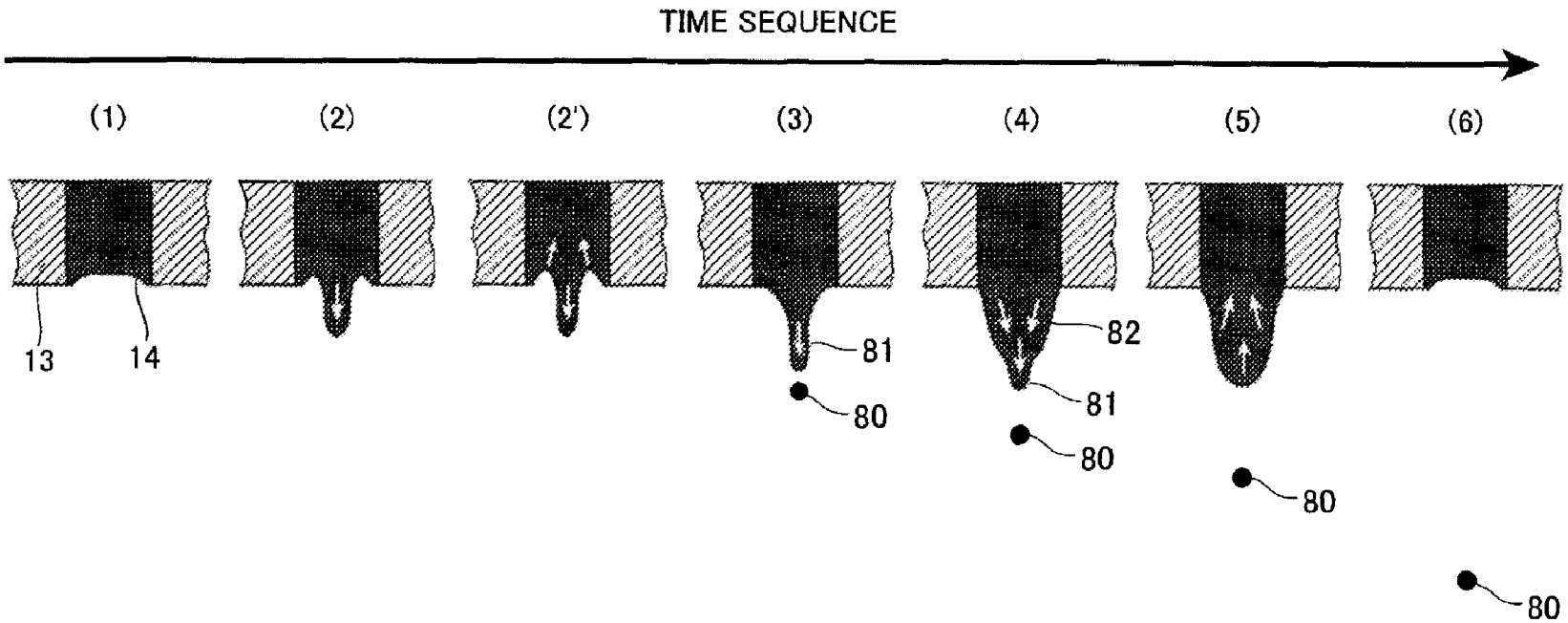
FIG. 5A is an explanatory diagram showing the result of ink droplet ejection when drive voltage waveforms shown in FIG. 2 is applied to the positive electrode of the piezoelectric element in the method of ejecting microdroplets of ink according to the first through third embodiments of the present invention.

FIG. 5A shows a result of the ink droplet ejection when applying the drive voltage waveform shown in FIG. 4 to the positive electrode 19 of the piezoelectric element 17. Timings (2') of FIG. 5A shows the ink microcolumn generated in the first stage of the first embodiment. As time elapses, the tip end of the microcolumn separates into a microdroplet 80 of ink, which begins to move away from the column, as shown in timing (3) of FIG. 5A. This is because the surface area per unit volume is large, so the ink column 81 is more likely to form a ball, enabling the microdroplet 80 of ink to separate from the head of the ink column. At this time, the ink column 81 positioned on the nozzle side of the microdroplet 80 of ink has a tendency to form into a small ink droplet or a plurality of ink droplets including small and microdroplets of ink moving away from the nozzle. However, an ink column 82 generated in the second stage of the embodiment overtakes the ink column 81 or ink droplets on the nozzle side of the initial microdroplet 80, as shown in timing (4) of FIG. 5A, and draws the ink column 81 or ink droplets back into the nozzle, as shown in timing (5) of FIG. 5A. In this way, it is possible to eject only the microdroplet 80 of ink separated from the tip end of the microcolumn of ink, as shown in timing (6) of FIG. 5A.

Figure 6A:
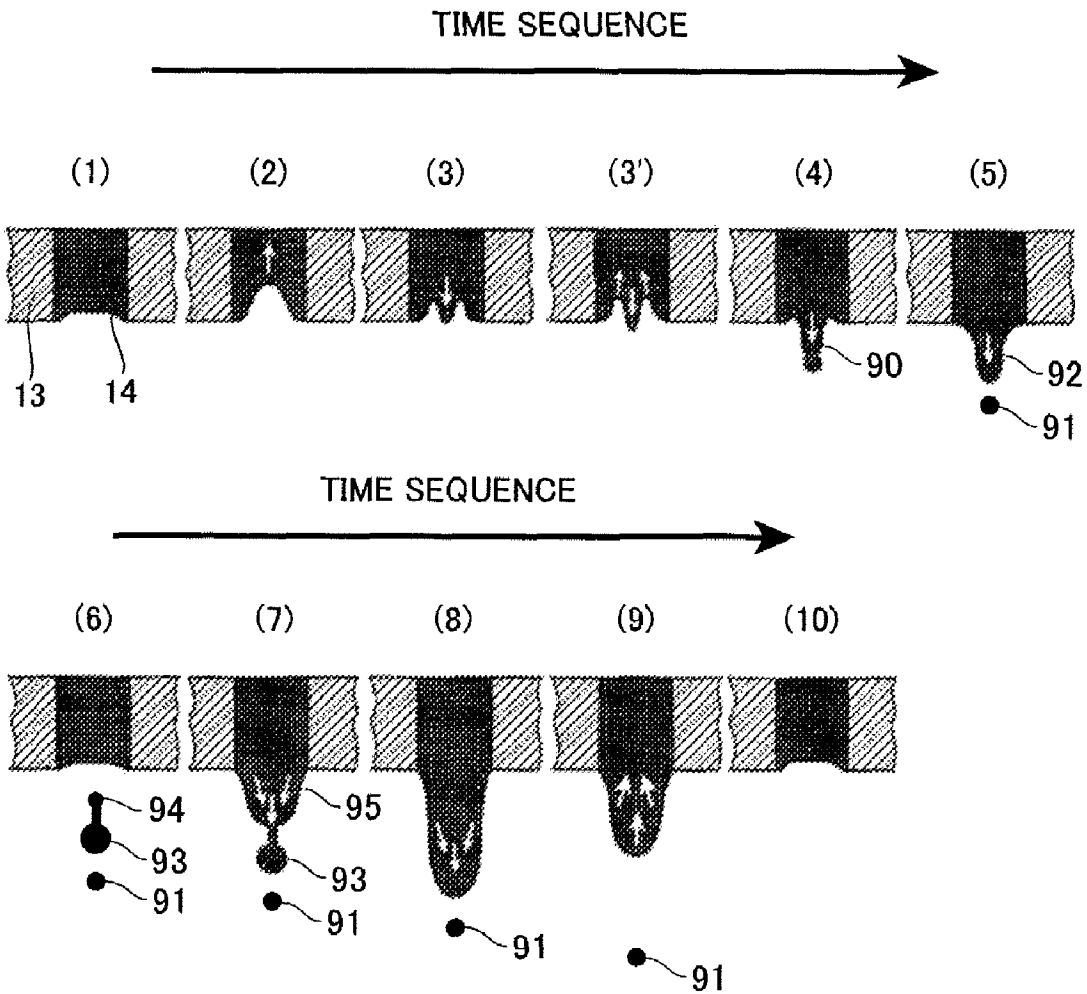
FIG. 6A is an explanatory diagram showing another result of ink droplet ejection when drive voltage waveforms shown in FIG. 2 is applied to the positive electrode of the piezoelectric element in the method of ejecting microdroplets of ink according to the first through third embodiments of the present invention.

FIG. 6A shows another result of the ink due to the ink properties (viscosity, surface tension, etc.) when applying the drive voltage waveform shown in FIG. 4 to the positive electrode 19 of the piezoelectric element 17. Specifically, the first stage produces a microcolumn 90 of ink, as shown in timing (3') of FIG. 6A. After more time elapses, the head of the microcolumn 90 separates into a microdroplet 91 of ink, as shown in timing (4) of FIG. 6A, that begins to move away from the microcolumn 90, as shown in (5) of FIG. 6A. An ink column 92 now remaining on the nozzle 14 side of the microdroplet 91 begins to form a small ink droplet or a plurality of ink droplets, including a small ink droplet 93 and a microdroplet 94, for example, that begin to move away from the nozzle 14, as shown in timing (6) of FIG. 6A. However, an ink column 95 generated in the second stage emerges from the nozzle 14 and overtakes and merges with the ink droplet 93 and microdroplet 94 positioned on the nozzle side of the first microdroplet 91, as illustrated in timings (7) and (8) of FIG. 6A. By drawing the merged ink back into the nozzle, as shown in timing (9) of FIG. 6A, only the microdroplet 91 of ink separated from the head of the microcolumn is allowed to be ejected, as shown in timing (10) of FIG. 6A.

In both cases shown in FIGS. 5A and 6A, step C of FIG. 4 also functions to ensure the position of the microdroplets 80 and 91 separated from the head of the microcolumns 82 and 95 are near the nozzle 14 so that the ink columns 82 and 95 generated in the second stage can easily merge with ink droplets attempting to follow the initial microdroplets 80 and 91.

By increasing the time Dt for step D to delay the time for generating the ink columns 82 and 95 in the second stage or by increasing the time Et and reducing the voltage Ev of step E to slow the volume velocity of the ink columns 82 and 95 generated in the second stage, it is possible to prevent the ink columns 82 and 95 from taking over the microdroplets 80 and 91 of ink separated from the tip end of the microcolumn generated in the first stage. Further, by reducing the time Dt to speed up the timing at which the ink columns 82 and 95 is generated in the second stage or by shortening the time Et and increasing the voltage Ev to speed up the volume velocity of the ink columns 82 and 95, the ink columns 82 and 95 can overtake and merge with the ink column or ink droplets positioned on the nozzle side of the initial microdroplets 80 and 91 of ink separated from the tip end of the microcolumn generated in the first stage and draw this ink column or these ink droplets back into the nozzle. The first embodiment described above is achieved by setting the time Dt, time Et, and voltage Ev to satisfy both of these conditions.

Figure 7:
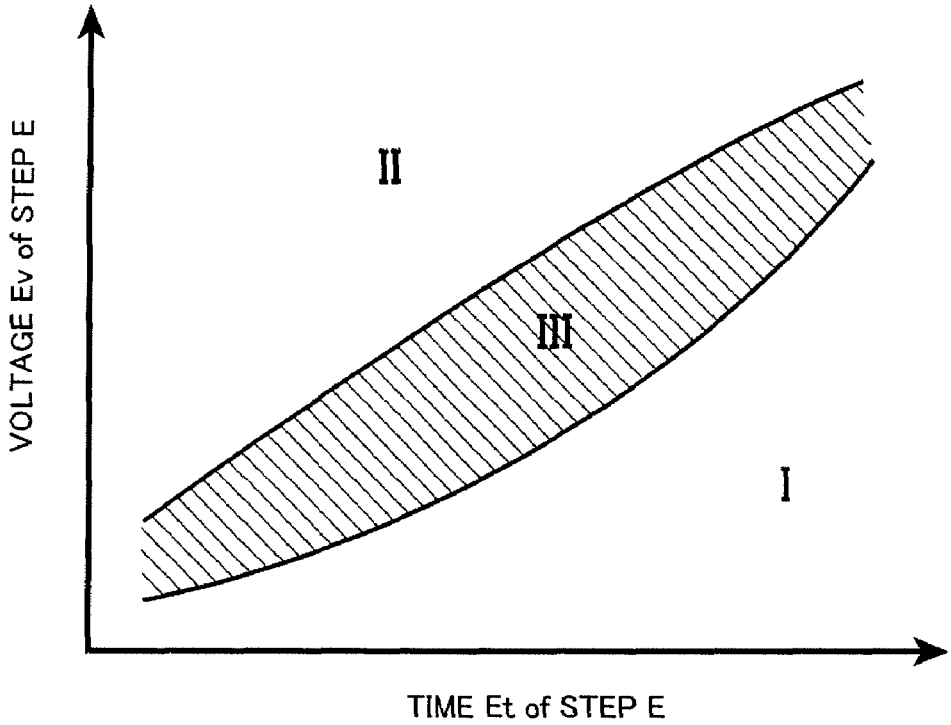
FIG. 7 is a graph showing an example region for appropriate drive voltage and time settings in the method of ejecting microdroplets of ink according to the first and third embodiments.

The graph in FIG. 7 shows the relationship between the time Et and voltage Ev of step E in FIG. 2. If the time Et is too long and/or the voltage Ev is too small (in region I), the ink columns 82 and 95 generated in the second stage cannot catch up to the ink column or ink droplets attempting to follow the microdroplet of ink formed in the first stage and cannot return this ink column or these ink droplets to the nozzle. Consequently, the ink column or ink droplets attempting to follow the microdroplet formed in the first stage continue to be ejected as small ink droplets. On the other hand, if the time Et is too short and/or the voltage Ev is too large (in region II), the ink columns 82 and 95 generated in the second stage is either ejected as a large ink droplet or catches and merges with the tip end of the microcolumn generated in the first stage and brings the tip back into the nozzle, resulting in no ink droplets being ejected.

The shaded region III in FIG. 7 indicates the suitable region of the first embodiment. By appropriately setting the time Et and voltage Ev in step E, the tip end of the microcolumn of ink generated in the first stage separates as microdroplets 80 and 91, and the ink columns 82 and 95 generated in the second stage catches and merges with the ink column or ink droplets on the nozzle side of the initial ink droplets 80 and 91 and bring this ink column or these ink droplets back into the nozzle, thereby achieving the ejection of microdroplets 80 and 91 of ink. With this method, high-density interconnects can be formed on a circuit board with conductive ink. Further, since the ejection principles of microdroplets of ink according to the preferred embodiment does not affect the natural frequency period of the ink pressure chambers 12, an inkjet head having large capacity ink pressure chambers 12 with a long natural frequency period that is suitable for ejecting large ink droplets can also eject microdroplets of ink. Hence, a single print head can eject ink droplets of different sizes more than 100 times different in volume.

The suitable region III shown in FIG. 7 will drop lower in the graph if the time Dt of step D is decreased, and higher in the graph if the time Dt is increased. The width of this suitable region changes according to the value of the time Dt and may even disappear if the time Dt is too long or too short. Further, when the temperature of the ink changes due to changes in ambient temperature and the like, the ink viscosity also changes, changing the suitable region in FIG. 7. Therefore, it is necessary to change one or a plurality of the time Dt of step D, the time Et of step E, and the voltage Ev of step E to fall within the suitable range and to maintain fluctuations of ink viscosity within a fixed range. Accordingly, it is desirable to provide an electric circuit for regulating the values for Dt, Et, and Ev and a temperature regulator for maintaining the ink viscosity within the fixed range so that changes in temperature or ink viscosity do not cause the set values to fall outside the suitable region.

In the first embodiment, when using a drive voltage waveform in which the voltage Av in step A is 23.6 V, the time At in step A is 0.2 μs, the time Bt in step B is 3 μs, the time Ct of step C is 1 μs, the time Dt of step D is 20 μs, the voltage Ev in step E is 39.4 V, and the time Et of step E is 20 μs and ink having a viscosity of 10 mPa·s and a surface tension of 31 mN/m, it is possible to produce the result of the ink droplet ejection shown in FIG. 5A. Hence, it is possible to reliably eject microdroplets of ink at 0.4 pl from a nozzle opening with a diameter of 38 μm about 1.5 mm from the nozzle at a velocity of 7 m/s. The method of the preferred embodiment can also reliably eject a microdroplet of ink at 0.5 pl a distance of about 2 mm from the nozzle opening at a speed of 14 m/s. The method of the invention can be implemented even without step C, by reducing the time Et of step E. Step C enables production of a smaller microcolumn of ink generated in the first stage. Further, step C makes it possible to increase the voltage Ev in step E so that the time Et of step E can be set to conform with the Helmholtz oscillation period to reduce residual oscillations after ink ejection. It is also possible to produce another result of the ink droplet ejection shown in FIG. 7 by modifying the ink properties.

Second Embodiment

Figure 8:
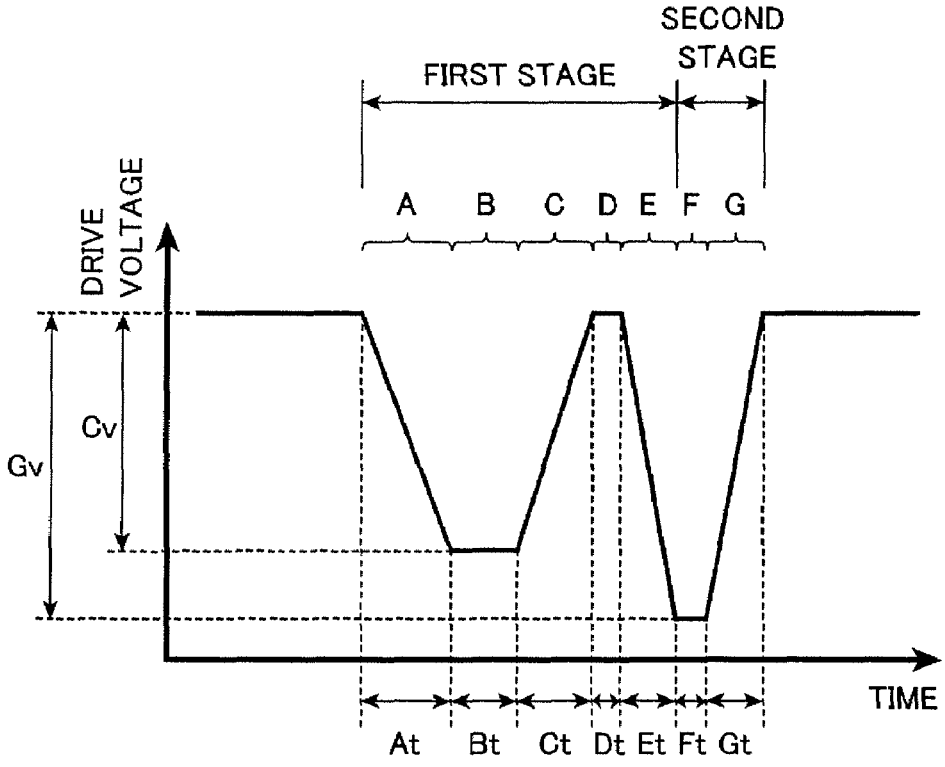
FIG. 8 is a graph showing a drive voltage waveform applied to a positive electrode of a piezoelectric element in the method of ejecting microdroplets of ink according to a second embodiment.

Next, a method of ejecting microdroplets of ink according to the second embodiment will be described. FIG. 8 is a graph of a drive voltage waveform applied to the positive electrode 19 of the piezoelectric element 17 according to a second embodiment of the present invention. In this method, steps A through E account for the first stage, and steps F and G account for the second stage. The first stage is for forming a microdroplet of ink on the outside of the nozzle 14. The second stage is for controlling the ink volume velocity in the ink pressure chambers 12 to generate an ink column. In the first stage, the meniscus is drawn into the nozzle in step A, the voltage is maintained for a fixed interval in step B, and the meniscus is pushed out in step C to generate an ink column. Once again the voltage is maintained for a fixed interval in step D, and the meniscus is drawn back into the nozzle in step E to reduce the volume of the ink column being ejected and to form a microcolumn of ink (timing (2') of FIG. 5A and timing (3') of FIG. 6A). In order to form a microcolumn of ink, it is preferable that the time Dt of step D be set no more than about 4 μs. In the second stage, the voltage is maintained for a fixed interval in step F, and ink is pushed out of the nozzle in step G to generate an ink column that returns to the nozzle.

FIGS. 5A and 6A show results of the ink droplet ejection when applying the drive voltage waveform shown in FIG. 8 to the positive electrode 19 of the piezoelectric element 17. The ink microcolumn is generated in the first stage of the second embodiment, as shown in timing (2') of FIG. 5A or timing (3') of FIG. 6A. As time elapses, the tip end of the microcolumn separates into a microdroplet 91 of ink, as shown in timing (4) of FIG. 6A, which begins to move away from the column, as shown in timing (3) of FIG. 5A or timing (5) of FIG. 6A. At this time, the ink column 81 positioned on the nozzle side of the microdroplet 80 of ink has a tendency to form into a small ink droplet or a plurality of ink droplets including small and microdroplets of ink moving away from the nozzle. However, an ink column 82 generated in the second stage of the embodiment overtakes the ink column 81 or ink droplets on the nozzle side of the initial microdroplet 80, as shown in timing (4) of FIG. 5A or timing (7) and (8) of FIG. 6A, and draws the ink column 81 or ink droplets back into the nozzle, as shown in timing (5) of FIG. 5A or timing (9) of FIG. 6A. In this way, it is possible to eject only the microdroplet 80 of ink separated from the tip end of the microcolumn of ink, as shown in timing (6) of FIG. 5A or timing (10) of FIG. 6A.

By increasing the time Ft for step F to delay the time for generating the ink columns 82 and 95 in the second stage or by increasing the time Gt and reducing the voltage Gv of step G to slow the volume velocity of the ink columns 82 and 95 generated in the second stage, it is possible to prevent the ink columns 82 and 95 from taking over the microdroplets 80 and 91 of ink separated from the tip end of the microcolumn generated in the first stage. Further, by reducing the time Ft to speed up the timing at which the ink columns 82 and 95 is generated in the second stage or by shortening the time Gt and increasing the voltage Gv to speed up the volume velocity of the ink columns 82 and 95, the ink columns 82 and 95 can overtake and merge with the ink column or ink droplets positioned on the nozzle side of the initial microdroplets 80 and 91 of ink separated from the tip end of the microcolumn generated in the first stage and draw this ink column or these ink droplets back into the nozzle. The second embodiment described above is achieved by setting the time Ft, time Gt, and voltage Gv to satisfy both of these conditions.

Figure 9:
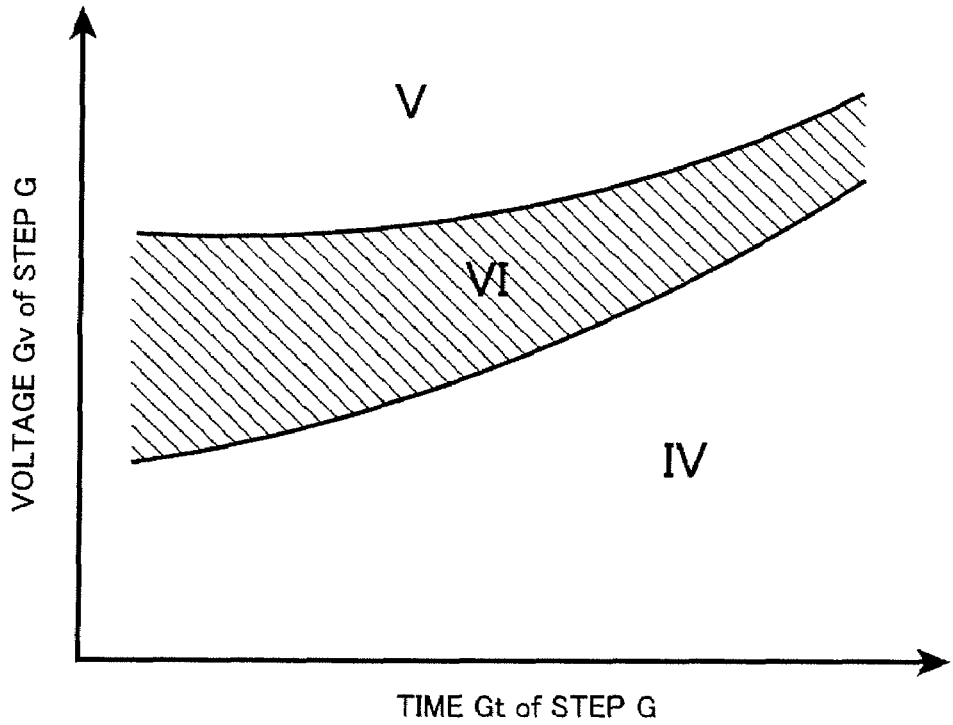
FIG. 9 is a graph showing an example region for appropriate drive voltage and time settings in the method of ejecting microdroplets of ink according to the second embodiment.

The graph in FIG. 9 shows the relationship between the time Gt and voltage Gv of step G in FIG. 8. If the time Gt is too long and/or the voltage Gv is too small (in region IV), the ink columns 82 and 95 generated in the second stage cannot catch up to the ink column or ink droplets attempting to follow the microdroplet of ink formed in the first stage and cannot return this ink column or these ink droplets to the nozzle. Consequently, the ink column or ink droplets attempting to follow the microdroplet formed in the first stage continue to be ejected as small ink droplets. On the other hand, if the time Gt is too short and/or the voltage Gv is too large (in region V), the ink columns 82 and 95 generated in the second stage is either ejected as a large ink droplet or catches and merges with the tip end of the microcolumn generated in the first stage and brings the tip back into the nozzle, resulting in no ink droplets being ejected.

The shaded region VI in FIG. 9 indicates the suitable region of the second embodiment. By appropriately setting the time Gt and voltage Gv in step G, the tip end of the microcolumn of ink generated in the first stage separates as microdroplets 80 and 91, and the ink columns 82 and 95 generated in the second stage catches and merges with the ink column or ink droplets on the nozzle side of the initial ink droplets 80 and 91 and bring this ink column or these ink droplets back into the nozzle, thereby achieving the ejection of microdroplets 80 and 91 of ink. Further, The suitable region VI shown in FIG. 9 will drop lower in the graph if the time Ft of step F is decreased, and higher in the graph if the time Ft is increased. The width of this suitable region changes according to the value of the time Ft and may even disappear if the time Ft is too long.

In the second embodiment, it is possible to reliably eject microdroplets of ink at 0.2 pl from a nozzle opening with a diameter of 28 μm about 1.5 mm from the nozzle opening at a velocity of 7 m/s when using ink having a viscosity of 10 mPa·s and a surface tension of 31 mN/m. This is achieved by applying a drive voltage waveform in which the time At in step A is 2.8 μs, the time Bt in step B is 2.2 μs, the voltage Cv in step C is 23 V, the time Ct of step C is 2.2 μs, the time Dt of step D is 0 μs, the time Et of step E is 2 μs, the time Ft of step F is 0 μs, the voltage Gv in step G is 23 V, and the time Gt of step G is 2 μs.

Third Embodiment

Figure 10:
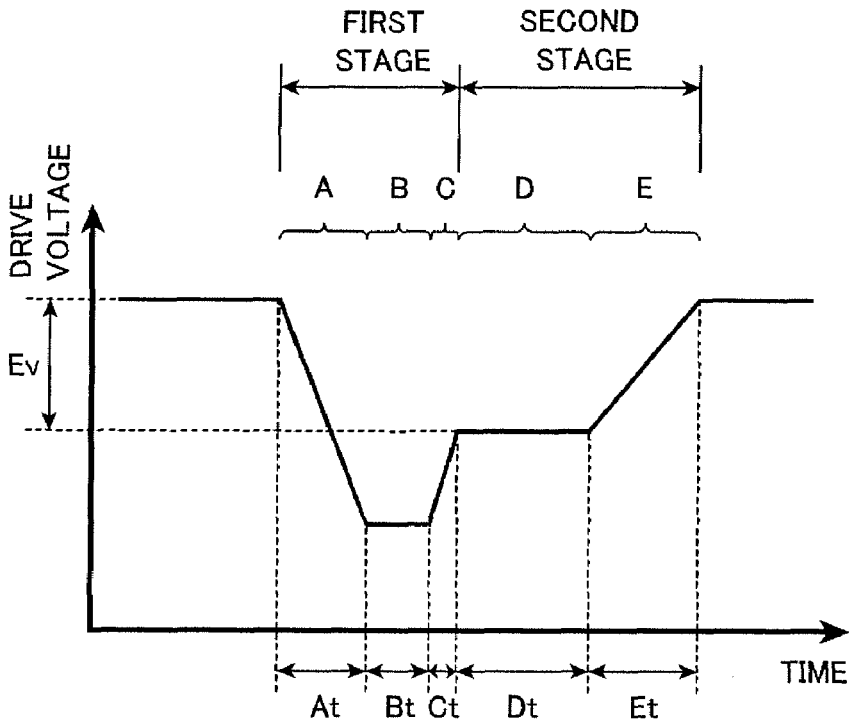
FIG. 10 is a graph showing a drive voltage waveform applied to a positive electrode of a piezoelectric element in the method of ejecting microdroplets of ink according to a third embodiment.

Next, a method of ejecting microdroplets of ink according to third embodiment of the present invention will be described. FIG. 10 is a graph showing a drive voltage waveform applied to the positive electrode 19 of the piezoelectric element 17 according to a third embodiment of the present invention. In this method, steps A through C account for the first stage, and steps D and E account for the second stage. The first stage is for forming a microdroplet of ink on the outside of the nozzle 14. The second stage is for controlling the ink volume velocity in the ink pressure chambers 12 to generate an ink column. In the first stage, the meniscus is drawn into the nozzle in step A, the voltage is maintained for a fixed interval in step B, and the meniscus is pushed out in step C to form a narrow ink column. In the second stage, the voltage is maintained at a fixed interval in step D, and ink is pushed out through the nozzle in step E to generate an ink column that returns into the nozzle.

Figure 5B:
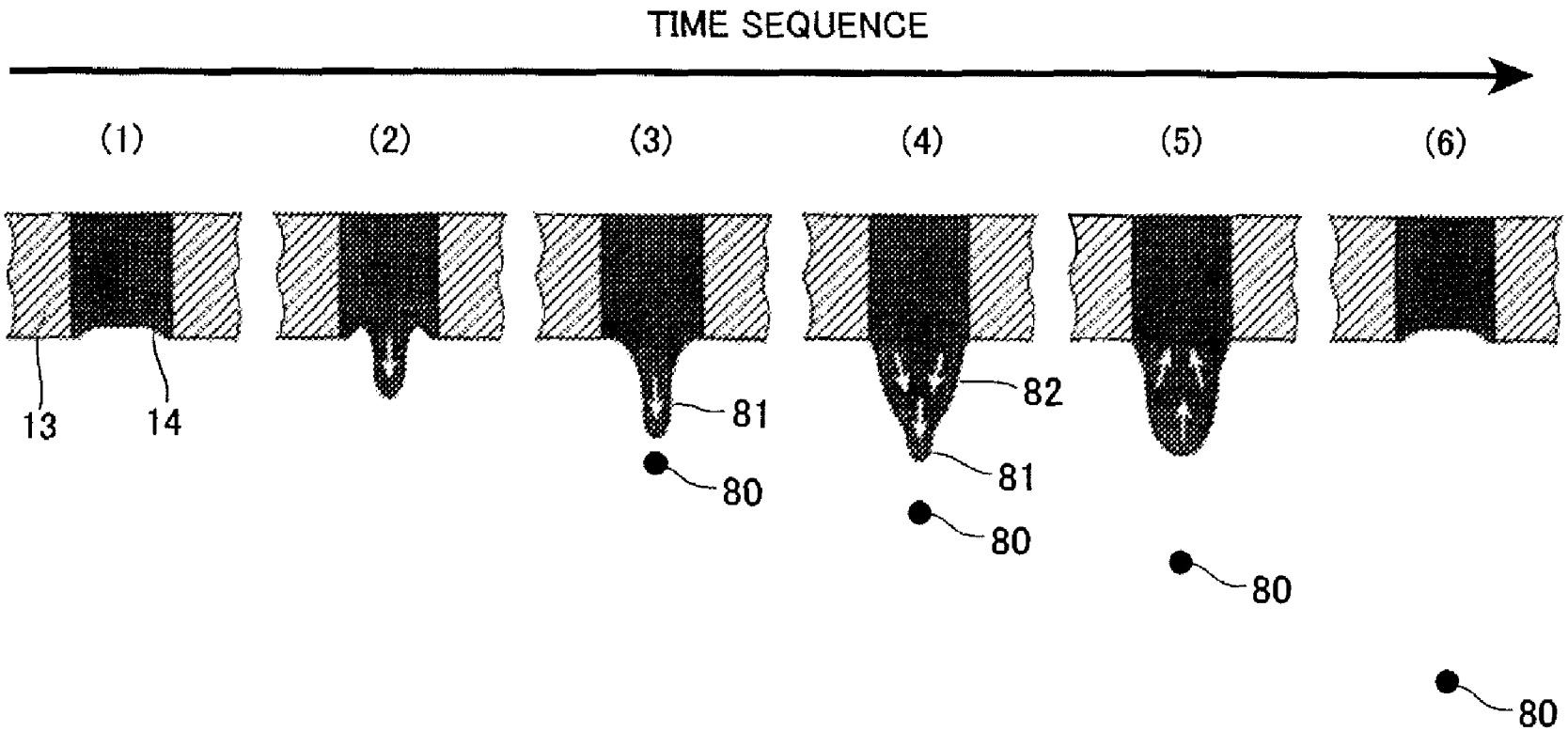
FIG. 5B is an explanatory diagram showing the result of ink droplet ejection when drive voltage waveforms shown in FIGS. 8 and 10 are applied to the positive electrode of the piezoelectric element in the method of ejecting microdroplets of ink according to the first through third embodiments of the present invention.
Figure 6B:
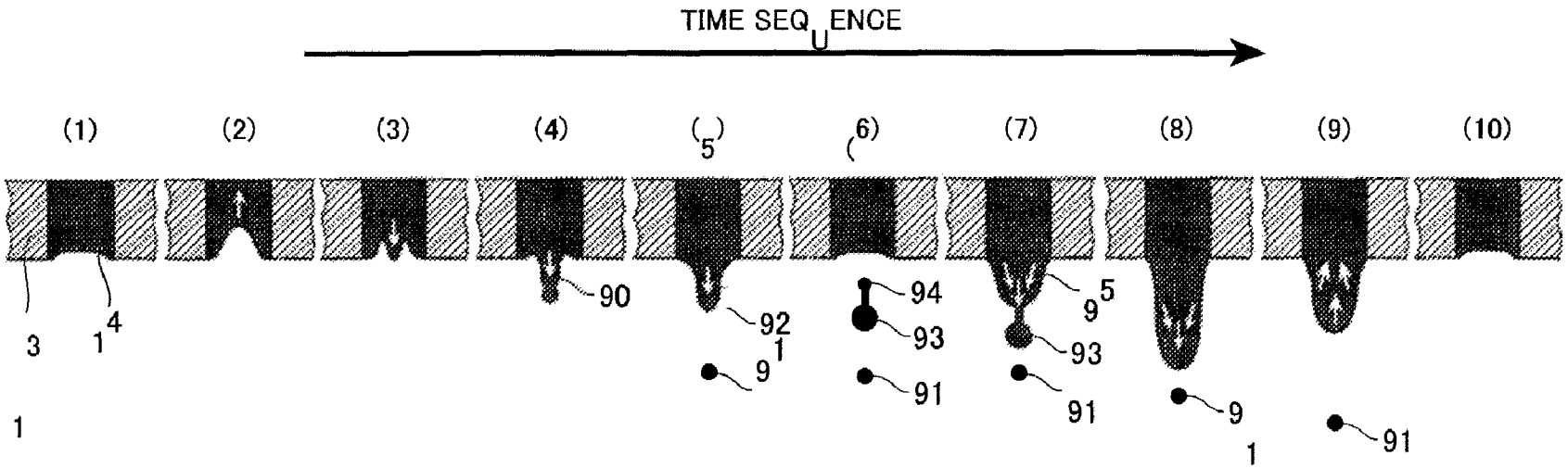
FIG. 6B is an explanatory diagram showing another result of ink droplet ejection when drive voltage waveforms shown in FIGS. 8 and 10 are applied to the positive electrode of the piezoelectric element in the method of ejecting microdroplets of ink according to the first through third embodiments of the present invention.

FIGS. 5B and 6B show results of the ink droplet ejection when applying the drive voltage waveform shown in FIG. 10 to the positive electrode 19 of the piezoelectric element 17. FIGS. 5B and 6B are same results of the ink droplet ejection shown in FIGS. 5A and 6A other than timings (2') and (3') of FIGS. 5A and 6A. The ink microcolumn is generated in the first stage of the second embodiment, as shown in timing (2) of FIG. 5B or timing (3) of FIG. 6B. As time elapses, the tip end of the microcolumn separates into a microdroplet 91 of ink, as shown in timing (4) of FIG. 6B, which begins to move away from the column, as shown in timing (3) of FIG. 5B or timing (5) of FIG. 6B. At this time, the ink column 81 positioned on the nozzle side of the microdroplet 80 of ink has a tendency to form into a small ink droplet or a plurality of ink droplets including small and microdroplets of ink moving away from the nozzle. However, an ink column 82 generated in the second stage of the embodiment overtakes the ink column 81 or ink droplets on the nozzle side of the initial microdroplet 80, as shown in timing (4) of FIG. 5B or timing (7) and (8) of FIG. 6B, and draws the ink column 81 or ink droplets back into the nozzle, as shown in timing (5) of FIG. 5B or timing (9) of FIG. 6B. In this way, it is possible to eject only the microdroplet 80 of ink separated from the tip end of the microcolumn of ink, as shown in timing (6) of FIG. 5B or timing (10) of FIG. 6B.

By increasing the time Dt for step D to delay the time for generating the ink columns 82 and 95 in the second stage or by increasing the time Et and reducing the voltage Ev of step E to slow the volume velocity of the ink columns 82 and 95 generated in the second stage, it is possible to prevent the ink columns 82 and 95 from taking over the microdroplets 80 and 91 of ink separated from the tip end of the microcolumn generated in the first stage. Further, by reducing the time Dt to speed up the timing at which the ink columns 82 and 95 is generated in the second stage or by shortening the time Et and increasing the voltage Ev to speed up the volume velocity of the ink columns 82 and 95, the ink columns 82 and 95 can overtake and merge with the ink column or ink droplets positioned on the nozzle side of the initial microdroplets 80 and 91 of ink separated from the tip end of the microcolumn generated in the first stage and draw this ink column or these ink droplets back into the nozzle. The third embodiment described above is achieved by setting the time Dt, time Et, and voltage Ev to satisfy both of these conditions.

The graph in FIG. 7 also shows the relationship between the time Et and the voltage Ev of step E of the third embodiment. As in the first embodiment, the time Et and voltage Ev of step E are set to satisfy the suitable region in FIG. 7.

The suitable region III shown in FIG. 7 will drop lower in the graph if the time Dt of step D is decreased, and higher in the graph if the time Dt is increased. The width of this suitable region changes according to the value of the time Dt, completely disappears if the time Dt is too long, and may disappear if the time Dt is too short.

Fourth Embodiment

Next, a method of ejecting microdroplets of ink according to forth embodiment of the present invention will be described. In the forth embodiment, a contact angle between the ink and the outer surface of the nozzle plate 13 at least in region around the nozzles 14 is no more than 30 degrees by treating the surface of the nozzles 14 to attract the ink or the ink with high wettability. Since the contact angle is no more than 30 degrees, ink pools 55 adhere to the outer surface of the nozzle plate 13 around the nozzles 14 as shown in FIG. 11.

Figure 11:
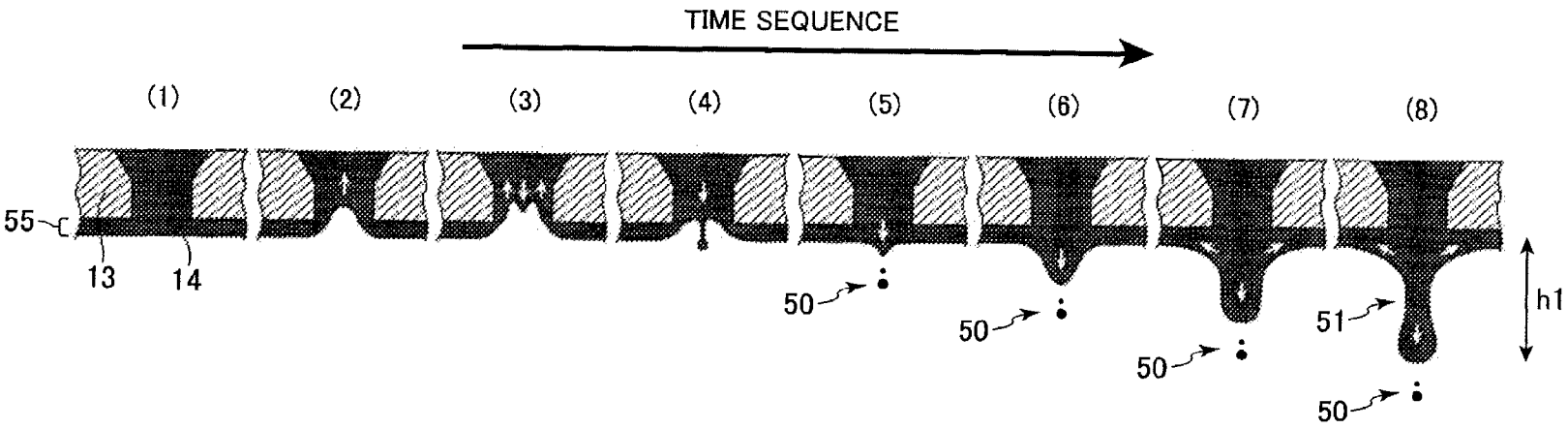
FIG. 11 is an explanatory diagram illustrating the behavior of ink in a method of ejecting microdroplets of ink according to a fourth embodiment of the present invention when ink pools adhere around the nozzles.
Figure 12:
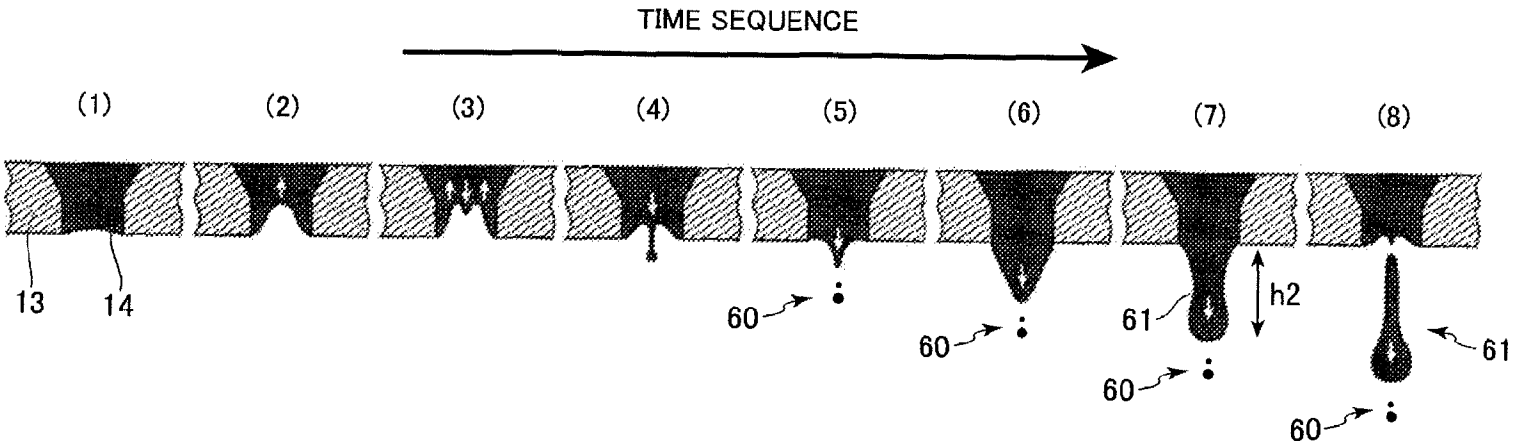
FIG. 12 is an explanatory diagram illustrating the behavior of ink in the method of ejecting microdroplets of ink according to the fourth embodiment of the present invention when ink pools do not adhere around the nozzles.

FIGS. 11 and 12 are explanatory diagrams illustrating the difference in ink behavior depending on the existence of ink pools 55 adhering to the surface of the nozzle plate 13 around the nozzles 14. FIG. 11 shows the case in which the ink pools 55 adhere around the nozzles 14, while FIG. 12 shows the case in which no ink pools adhere around the nozzles 14. Both FIGS. 11 and 12 illustrate the state of ink around the nozzles 14 when applying only the drive waveform of the first stage of the first embodiment in the present invention.

As shown in timings (1)-(8) of FIGS. 11 and 12, microdroplets 50 and 60 of ink formed in the first stage are ejected from the center of the meniscus after the meniscus is drawn into the nozzle 14 (timings (3) and (4) of FIG. 11 and (3) and (4) and FIG. 12). Hence, the microdroplets 50 and 60 are ejected regardless of the existence of the ink pools 55 adhering around the nozzles 14. In other words, the microdroplets 50 and 60 are almost unaffected by the ink collected around the nozzles 14 and are ejected in the same way whether the ink pools 55 adhere or do not adhere around the nozzles 14.

However, the behavior of the ink column that follows the microdroplets 50 and 60 formed in the first stage is quite different depending on the existence of the ink pools 55. When the ink pools 55 adhere around the nozzles 14, ink is supplied to an ink column 51 from the ink collected around the nozzle 14, and the viscosity of the collected ink pulls on the ink column 51. Accordingly, the ink column 51 is less likely to break away from the ink on the nozzle 14 side, which would result in the ink column 51 being less likely to be ejected as an ink droplet.

On the other hand, when the ink pools 55 do not adhere, an ink column 61 is more likely to break away from the ink on the nozzle 14 side and be ejected, as shown in timings (6)-(8) of FIG. 12. Therefore, the presence of the ink pools 55 expands the limit to which the ink column generated in the second stage can return to the nozzle 14 (the expanse of the suitable region shown in FIGS. 7 and 9). More specifically, if timing (8) of FIG. 11 shows the limit at which the ink column 51 or ink droplets following the initial microdroplet 50 can be returned in the second stage when ink pools 55 adhere around the nozzles 14, timing (7) of FIG. 12 shows the limiting point at which the ink column 61 or ink droplets following the initial microdroplet 60 can be returned in the second stage when ink pools do not adhere, and the distance from the nozzle 14 to the head of the ink column 61 or ink droplet to be drawn back into the nozzle 14 is h1 and h2, respectively, then h1>h2, indicating that the ink can be drawn back from a farther distance when the ink pools 55 adhere around the nozzles 14. Further, more time has elapsed in (8) of FIG. 11 than in (7) of FIG. 12, indicating that a construction including the ink pools 55 can return the ink column and the like after more elapsed time.

As described above, the contact angle between the ink and the outer surface of the nozzle plate 13 in region around the nozzles 14 is no more than 30 degrees, and ink pools 55 adhere around the nozzles 14. Therefore, the desired microdroplet is ejected without problem, while the ink column or ink droplets emerging after the microdroplet can be returned in the second stage. If the contact angle is greater than 30 degrees, ink pools suitable for the present invention do not adhere around the nozzles 14. Specifically, if the contact angle is too large, a bias may be produced in the ink pool, resulting in the ink droplet being ejected at an angle or an ejection failure.

Figure 13:
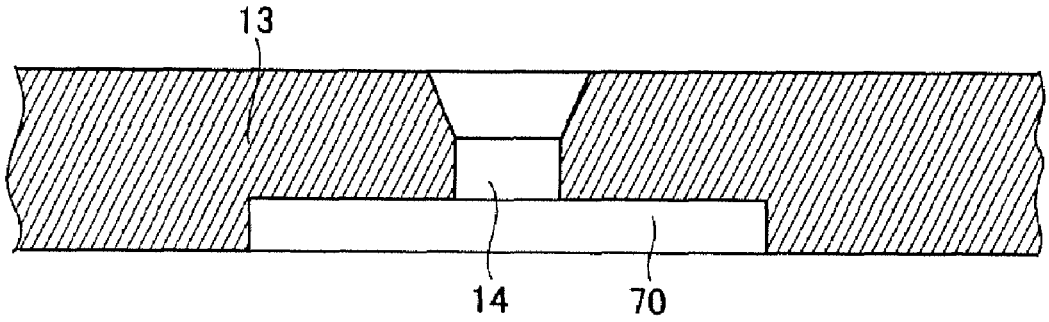
FIG. 13 is a cross sectional view showing a variation of the structure around the nozzle in the method of ejecting microdroplets of ink according to the fourth embodiment.
Figure 14:
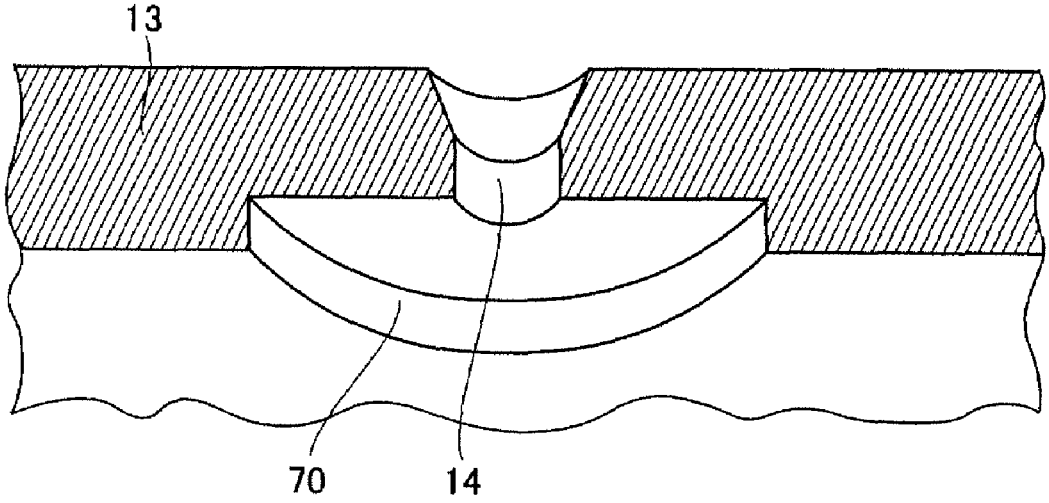
FIG. 14 is a perspective view of a cross section showing a variation of the structure around the nozzle in the method of ejecting microdroplets of ink according to the fourth embodiment.

When continuously ejecting ink droplets from the nozzle 14, the contact angle between the ink and the outer surface of the nozzle plate 13 in the region around the nozzles 14 being 30 degrees or less, ink may gradually seep out and collect to an extent that results in ejection problems. To avoid this, a barrier wall 70 may be formed on the outer side of the nozzle plate 13 around the nozzle 14, as shown in FIGS. 13 and 14. In this way, it is possible to suppress the spreading of ink.

While the invention has been described in detail with reference to specific embodiments thereof, it would be apparent to those skilled in the art that many modifications and variations may be made therein without departing from the spirit of the invention, the scope of which is defined by the attached claims. While the piezoelectric elements in the preferred embodiments described above eject ink through displacement orthogonal to the electrode (longitudinal piezoelectric constant d33), the piezoelectric elements may be a type for ejecting ink through displacement parallel to the electrode (transverse piezoelectric constant d31). Additionally, the piezoelectric elements may eject ink through displacement in a shear mode or bending mode.

Further, while microdroplets of ink are ejected according to a method of applying pressure through the expansion and contraction of piezoelectric elements in the preferred embodiments described above, this ink ejection may be achieved through another method using the expansion force of bubbles, electrostatic force, or magnetic force.

The preferred embodiment may also be provided with a mechanism for adjusting the time Et or Gt and the drive voltage Ev or Gv in FIGS. 4, 8 and 10 in the second stage when the viscosity and other properties of the ink change so that the values are always maintained within the suitable region III or VI in FIGS. 7 and 9. Specifically, as indicated by broken lines in FIG. 1A, a waveform table 36 is provided in the drive voltage generating circuit 34, and a thermistor 37 is provided on the inkjet recording device 30. The waveform table 34 has a plurality of sets of relationship data in one to one correspondence with a plurality of different temperatures. One set of relationship data for each temperature includes data of ink properties (ink viscosity and other properties) that the ink will exhibit at the subject temperature and data of a drive voltage waveform that defines the time Et or Gt and the magnitude Ev or Gv of the drive voltage that are appropriate for the ink at the subject temperature. The thermistor 37 monitors the ink temperature and sends data of the ink temperature to the drive voltage generating circuit 34. The drive voltage generating circuit 34 selects one drive voltage waveform among the plurality of sets of relationship data based on the monitored ink temperature, and outputs the selected drive voltage waveform to the drive nozzle selection circuit 35. So, this arrangement can control the magnitude and the timing of the drive voltage to the variations in the ink viscosity and other ink properties.

Alternatively, the preferred embodiment may be provided with a temperature regulating mechanism to maintain the temperature of the ink substantially uniform so that the viscosity and other properties of the ink change very little. Specifically, as indicated by broken line in FIG. 1A, the temperature regulating mechanism includes the thermistor 37, a peltiert element 38 and a temperature comparator 39. In this case, the waveform table 36 is not provided in the drive voltage generating circuit 34. The peltiert element 38 is provided on the inkjet recording device 30. The temperature comparator 39 is provided in the drive voltage generating circuit 34. The thermistor 37 monitors the ink temperature and sends data of the ink temperature to the temperature comparator 39. The temperature comparator 39 compares the monitored ink temperature with a predetermined temperature. When the monitored ink temperature becomes lower than the predetermined temperature, the drive voltage generating circuit 34 increases the ink temperature by controlling the peltiert element 38. When the monitored ink temperature becomes higher than the predetermined temperature, the drive voltage generating circuit 34 decreases the ink temperature by controlling the peltiert element 38. Thus, the temperature is kept at the predetermined temperature, and the ink property is kept at a constant state. In this case, one drive voltage waveform that corresponds to the predetermined temperature is always applied to the drive voltage generating circuit 34.

For example, when at least one ink droplet 42 or 43 larger than the microdroplet separated from the end of the ink column is moving away from the nozzle (timings (4) and (5) of FIG. 3) after the microdroplet 41 has separated from the tip end of the ink column (timing (3) of FIG. 3), the present invention can recover the large ink droplet 43 into the nozzle 14 so that only the microdroplet 41 is ejected, thereby enhancing the effects of the microdroplet of ink. To attain such ejection, it is effective to generate a thinner ink column in the first stage. This is because the surface area per unit volume is large, so the ink column is more likely to form a ball, enabling a microdroplet of ink to separate from the head of the ink column. Further, when the viscosity or surface tension of the ink increases, the ink column tends to stretch instead of break off, facilitating the formation of a ball at the end of the ink column.

What is claimed is:

1. A method of ejecting microdroplets of ink by driving an inkjet head comprising a plate formed with a plurality of nozzles for ejecting ink droplets and a plurality of pressure chambers in fluid communication with the plurality of nozzles, respectively, and a pressure generating member for applying pressure to ink in each ink pressure chamber in response to electric signals applied to the pressure generating member, the plate having an outside surface, on which the nozzle is opened, the method comprising:

a first step for generating one ink column on the outside of the nozzle and for separating a tip end of the one ink column from a remaining part of the one ink column to form a microdroplet of ink on the outside of one nozzle; and a second step for controlling an ink volume velocity in the ink pressure chamber that is connected to the nozzle to generate another ink column and to push the another ink column out of the nozzle, thereby causing the another ink column to overtake and merge with the remaining part of the one ink column and to return into the nozzle while pulling the remaining part of the one ink column back into the nozzle.

2. The method of ejecting microdroplets of ink according to claim 1, wherein the first step comprises a step of rapidly drawing in a meniscus into the nozzle, and causing the meniscus to rebound to generate the one ink column.

3. The method of ejecting microdroplets of ink according to claim 1, wherein the first step comprises:

a step of rapidly drawing in a meniscus into the nozzle, causing the meniscus to rebound and generate the one ink column; and a step of again drawing in the meniscus into the nozzle to reduce volume of the one ink column.

4. The method of ejecting microdroplets of ink according to claim 1, wherein the first step comprises:

a step of drawing in the meniscus into the nozzle;

a step of pushing ink out of the nozzle to generate the one ink column; and a step of drawing in the meniscus into the nozzle again to reduce volume of the one ink column.

5. The method of ejecting microdroplets of ink according to claim 1, wherein a contact angle between the ink and the outside surface of the plate at least in a region around the nozzles is no more than 30 degrees.

6. The method of ejecting microdroplets of ink according to claim 1, wherein the inkjet head further comprises a controller that controls magnitude and timing of the electric signals in the second step according to variations in ink viscosity.

7. The method of ejecting microdroplets of ink according to claim 1, wherein the inkjet head further comprises a temperature regulator for maintaining temperature of the ink at a substantially constant temperature.

8. The method of claim 1, wherein ejected microdroplets have a volume of 1 picoliter or less.

9. An ink jet head comprising:

a plate formed with a plurality of nozzles for ejecting ink droplets and a plurality of pressure chambers in fluid communication with the plurality of nozzles, respectively, the plate having an outside surface, on which the nozzles are opened;

a pressure generating member for applying pressure to ink in each ink pressure chamber in response to electric signals applied to the pressure generating member; and a controller that controls ejecting of microdoplets of ink from the nozzles, the ejecting microdroplets of ink comprising: a first step for generating one ink column on the outside of the nozzle and for separating a tip end of the one ink column from a remaining part of the one ink column to form a microdroplet of ink on the outside of one nozzle; and a second step for controlling an ink volume velocity in the ink pressure chamber that is connected to the nozzle to generate another ink column and to push the another ink column out of the nozzle, thereby causing the another ink column to overtake and merge with the remaining part of the one ink column and to return into the nozzle while pulling the remaining part of the one ink column back into the nozzle.

10. The ink jet head of claim 9, wherein ejected microdroplets have a volume of 1 picoliter or less.

11. A method of ejecting microdroplets of ink by driving an inkjet head comprising a plate formed with a plurality of nozzles for ejecting ink droplets and a plurality of pressure chambers in fluid communication with the plurality of nozzles, respectively, and a pressure generating member for applying pressure to ink in each ink pressure chamber in response to driving voltage applied to the pressure generating member, the plate having an outside surface, on which the nozzles are opened, the method comprising:

decreasing the driving voltage to rapidly draw in a meniscus of the ink into the nozzle;

maintaining the driving voltage at a constant value for a period of time, thereby allowing the meniscus to rebound and generate one ink column;

decreasing the driving voltage to reduce volume of the one ink column;

maintaining the driving voltage at another constant value for another period of time to separate a tip end of the one ink column from a remaining part of the one ink column to form a microdroplet of ink; and increasing the driving voltage to generate another ink column to push the another ink column out of the nozzle to cause the another ink column to overtake and merge with the remaining part of the one ink column and pull the remaining part of the one ink column into the nozzle.

12. The method of claim 11, wherein ejected microdroplets have a volume of 1 picoliter or less.

* * * * *